US008528606B1

(12) United States Patent
Seiver

(10) Patent No.: US 8,528,606 B1
(45) Date of Patent: Sep. 10, 2013

(54) APPARATUS AND METHODS FOR FILLING CONTAINERS WITH NON-LIQUIDS

(76) Inventor: Michael J. Seiver, Houston, TX (US)

( * ) Notice: Subject to any disclaimer, the term of this patent is extended or adjusted under 35 U.S.C. 154(b) by 1336 days.

(21) Appl. No.: 12/270,130

(22) Filed: Nov. 13, 2008

Related U.S. Application Data

(60) Provisional application No. 61/003,053, filed on Nov. 14, 2007.

(51) Int. Cl.

| | |
|---|---|
| ***B65B 1/04*** | (2006.01) |
| ***B65B 3/16*** | (2006.01) |
| ***B65B 3/00*** | (2006.01) |
| ***B65B 3/04*** | (2006.01) |

(52) U.S. Cl.
USPC ..... 141/10; 141/114; 141/166; 141/314

(58) Field of Classification Search
USPC ..... 141/10, 114, 313, 314, 166; 294/197, 294/81.6, 81.61, 67.31
See application file for complete search history.

(56) References Cited

U.S. PATENT DOCUMENTS

| | | | | |
|---|---|---|---|---|
| 2,010,994 | A | | 8/1935 | Irmscher |
| 2,654,518 | A | | 10/1953 | Kindseth |
| 2,767,743 | A | | 10/1956 | Kindseth |
| 3,405,744 | A | | 10/1968 | Bowman |
| 3,750,721 | A | | 8/1973 | Hudson |
| 3,830,266 | A | | 8/1974 | Hudson |
| RE29,384 | E | | 9/1977 | Hudson |
| 4,049,028 | A | | 9/1977 | Harris et al. |
| 4,056,132 | A | | 11/1977 | Decrane |
| 4,081,004 | A | | 3/1978 | Harris |
| D251,249 | S | | 3/1979 | DeCrane |
| 4,519,426 | A | | 5/1985 | Hardy, Jr. |
| 4,676,284 | A | | 6/1987 | DeCrane |
| 4,863,065 | A | | 9/1989 | Decrane |
| 4,996,311 | A | | 2/1991 | Moussavi et al. |
| D315,627 | S | | 3/1991 | DeCrane |
| 5,036,893 | A | | 8/1991 | DeCrane |
| 5,042,538 | A | * | 8/1991 | Wiese ..... 141/93 |
| 5,056,571 | A | * | 10/1991 | Derby ..... 141/114 |
| 5,184,759 | A | | 2/1993 | Gill et al. |
| 5,259,425 | A | | 11/1993 | Johnson et al. |
| 5,269,579 | A | | 12/1993 | DeCrane |
| D346,253 | S | | 4/1994 | DeCrane |
| 5,400,837 | A | | 3/1995 | Kelley et al. |

(Continued)

FOREIGN PATENT DOCUMENTS

| | | |
|---|---|---|
| CA | 2299708 A1 | 8/2001 |
| CA | 2304916 A1 | 10/2001 |
| CA | 2436267 A1 | 1/2005 |

OTHER PUBLICATIONS

Control & Metering Limited, "World Class Bulk Bag Fillers and Dischargers", www.controlandmetering.com, 2 pages, Jul. 26, 2006.

(Continued)

*Primary Examiner* — Len Tran
*Assistant Examiner* — Steven M Cernoch
(74) *Attorney, Agent, or Firm* — Jones & Smith, LLP; E. Randall Smith

(57) ABSTRACT

In some embodiments, apparatus useful for filling non-liquid material into a container includes first and second front and rear grippers that are each non-manually laterally movable between at least first and second positions.

21 Claims, 4 Drawing Sheets

(56) References Cited

U.S. PATENT DOCUMENTS

| | | | | |
|---|---|---|---|---|
| 5,443,102 | A | 8/1995 | Svendsen | |
| 5,558,137 | A | 9/1996 | Futerman | |
| 5,564,264 | A | 10/1996 | DeCrane | |
| 5,657,801 | A | 8/1997 | Ellis | |
| 5,787,945 | A * | 8/1998 | Riemersma | 141/314 |
| 5,913,459 | A | 6/1999 | Gill et al. | |
| 5,975,155 | A | 11/1999 | Sienerth et al. | |
| 6,089,283 | A | 7/2000 | Sienerth et al. | |
| 6,149,110 | A | 11/2000 | Gill et al. | |
| 6,176,278 | B1 | 1/2001 | Gill et al. | |
| 6,186,195 | B1 | 2/2001 | Anstotz | |
| 6,290,098 | B1 | 9/2001 | Sterner et al. | |
| 6,340,100 | B1 | 1/2002 | Gill et al. | |
| 6,474,372 | B2 | 11/2002 | Sanderson et al. | |
| 6,564,534 | B2 | 5/2003 | Poulton et al. | |
| 6,776,197 | B1 | 8/2004 | DeCrane | |
| 6,892,510 | B2 | 5/2005 | Sterner et al. | |
| 6,955,195 | B1 | 10/2005 | Marceau et al. | |
| 6,968,670 | B2 | 11/2005 | Wilson | |
| 6,978,812 | B2 | 12/2005 | Summerville | |
| 7,004,212 | B2 | 2/2006 | Gill et al. | |
| 7,025,097 | B1 | 4/2006 | Hayes | |
| 7,032,875 | B2 | 4/2006 | Sterner et al. | |
| 7,036,538 | B2 | 5/2006 | Schlosser | |
| 7,267,144 | B2 * | 9/2007 | Nyhof et al. | 141/314 |
| 7,267,145 | B2 * | 9/2007 | Nyhof et al. | 141/314 |
| 8,181,679 | B2 * | 5/2012 | Vollenkemper | 141/315 |
| 2001/0027822 | A1 | 10/2001 | Bertolo | |
| 2002/0040567 | A1 | 4/2002 | Morris | |
| 2003/0006248 | A1 | 1/2003 | Gill et al. | |
| 2003/0217528 | A1 | 11/2003 | Wilson | |
| 2004/0206780 | A1 | 10/2004 | Sterner et al. | |
| 2005/0022700 | A1 | 2/2005 | Mackrill et al. | |
| 2005/0263209 | A1 | 12/2005 | Dietrich et al. | |
| 2006/0032551 | A1 | 2/2006 | Sterner et al. | |
| 2006/0151059 | A1 | 7/2006 | Ours et al. | |
| 2009/0314386 | A1 * | 12/2009 | Koga et al. | 141/314 |

OTHER PUBLICATIONS

Flexicon, "Bulk Bag Fillers", www.flexicon.com/us/Products/BulkBagFillers/index.asp, 2 pages, Jun. 28, 2005. X.

* cited by examiner

APPARATUS AND METHODS FOR FILLING CONTAINERS WITH NON-LIQUIDS

This application claims priority to U.S. Provisional Patent Application Ser. No. 61/003,053 filed Nov. 14, 2007, the entire disclosure of which is hereby incorporated by reference herein in its entirety.

BACKGROUND

The present invention relates generally to apparatus, methods and systems for filling containers with non-liquid materials.

Various machines and systems involve the filling of boxes, bags and other types of containers (collectively "containers") with non-liquid materials. These container filling systems may be used for example, in the rapid, precision filling of large containers with hundreds of pounds of sensitive material in large scale assembly-line type operations. Various embodiments of these systems are sometimes referred to as "bulk bag", "dry solids", "supersack" or "FIBC" (flexible individual bulk container) fillers.

The effective and successful utilization of container filling systems may depend upon various factors, such as, for example, speed and ease of use, safety and purity of material. In some instances, safety may be a concern with respect to an operator having to reach out over, or across, the equipment to perform one or more function, such as engaging the container with the system. For another example, safety, speed and ease of use may be a factor when an operator has to carefully and fully clean the fill-spout of the system upon changing the type of material to be dispensed. In use of many current systems, fill-spout cleaning requires the cumbersome procedure of lifting the operator on a pallet with a forklift and positioning him/her proximate to the fill-spout.

Accordingly, there exists a need for non-liquid container filling apparatus, systems and/or methods having one or more of the following attributes, capabilities or features: may improve safety in the use, maintenance, inspection, cleaning or repair of the equipment; allows an operator to engage a container with one or more components of the system without having to reach out substantially laterally across the equipment; reduces operator strain in various aspects of the use, maintenance, inspection, cleaning or repair of the system; reduces the time or effort necessary for certain operations to be performed; allows multiple hooks or grippers of the system to be non-manually moved between positions; is not cumbersome; allows an operator access to various components of the system without the use of a forklift; improves the speed with which at least one among the operation, maintenance, inspection, cleaning or repair of the system may be performed; is reliable; is cost-efficient; is easy to use; is easy to implement; does not require complex equipment; or a combination thereof.

It should be understood that the above-described examples, features, advantages and/or disadvantages are provided for illustrative purposes only and are not intended to limit the scope or subject matter of the appended claims or any other patent application or patent claiming priority hereto. Thus, none of the appended claims or claims of any related application or patent should be limited by the above discussion or construed to address, include or exclude the cited examples, features, advantages and/or disadvantages, except and only to the extent as may be expressly stated in a particular claim.

BRIEF SUMMARY OF THE DISCLOSURE

In some embodiments, the present disclosure involves an apparatus useful for filling non-liquid material into a container that is releasably engageable with the apparatus. The apparatus typically includes a framework having an upper portion, a base, a front end and a rear end, and at least one filling spout associated with the framework. The apparatus includes first and second front and rear grippers. Each gripper is engageable with a different portion of the container. The first and second rear grippers are linearly aligned with the first and second front grippers, respectively. The rear grippers are each non-manually laterally movable between a first position that allows filling of a container engaged therewith and a second position that is forward of the first position and allows engagement of a container therewith. The front grippers are each non-manually movable between a first position that allows filling of a container engaged therewith and a second position that is forward of the first position and provides clearance for movement of the respective associated rear gripper into its second position.

In various embodiments, the present disclosure involves an apparatus useful for filling non-liquid material into a container that is releasably engageable with the apparatus. The apparatus typically includes a framework having an upper portion, a base, a front end and a rear end, and at least one filling spout associated with the framework. The apparatus includes first and second front and rear grippers, each engageable with a different portion of the container. The first and second rear grippers are linearly aligned with the first and second front grippers, respectively. First and second power-operated drivers are associated with the first and second rear grippers, respectively, and capable of allowing the non-manual lateral movement of all of the grippers between at least two positions. The first and second power-operated drivers are capable of moving the first and second rear grippers between a rearward home position and a forward position, respectively.

The first and second rear grippers of these embodiments are capable of pushing the first and second front grippers from a home position to a forward position, respectively. First and second draggers are engaged between the first and second front and rear grippers, respectively, and allow each rear gripper to pull its associated front gripper from a forward position to a home positions, respectively.

There are embodiments of the present disclosure that involve a method of filling non-liquid material into a container with the use of an apparatus having a framework, at least one filling spout and first and second front and rear grippers each capable of engaging a different portion of the container. The framework typically includes an upper portion, a base, a front end and a rear end. The first front and rear grippers are linearly aligned and the second front and rear grippers are linearly aligned. The grippers are each capable of engaging a different portion of the container. These embodiments include the following acts, which are not necessarily performed in the order mentioned. Each of the rear grippers is non-manually moved to a forward position. Each of the front grippers is non-manually moved to a forward position that allows movement of the associated rear grippers to their forward positions, respectively. The container is engaged with each of the rear grippers. Each of the rear grippers is non-manually moved rearward to a filling position and each of the front grippers is non-manually moved rearward to a filling position. The container is engaged with the filling spout. The container is engaged with each of the front grippers.

Accordingly, the present disclosure includes features and advantages which are believed to enable it to advance non-liquid container filling technology. Characteristics and advantages of the present invention described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
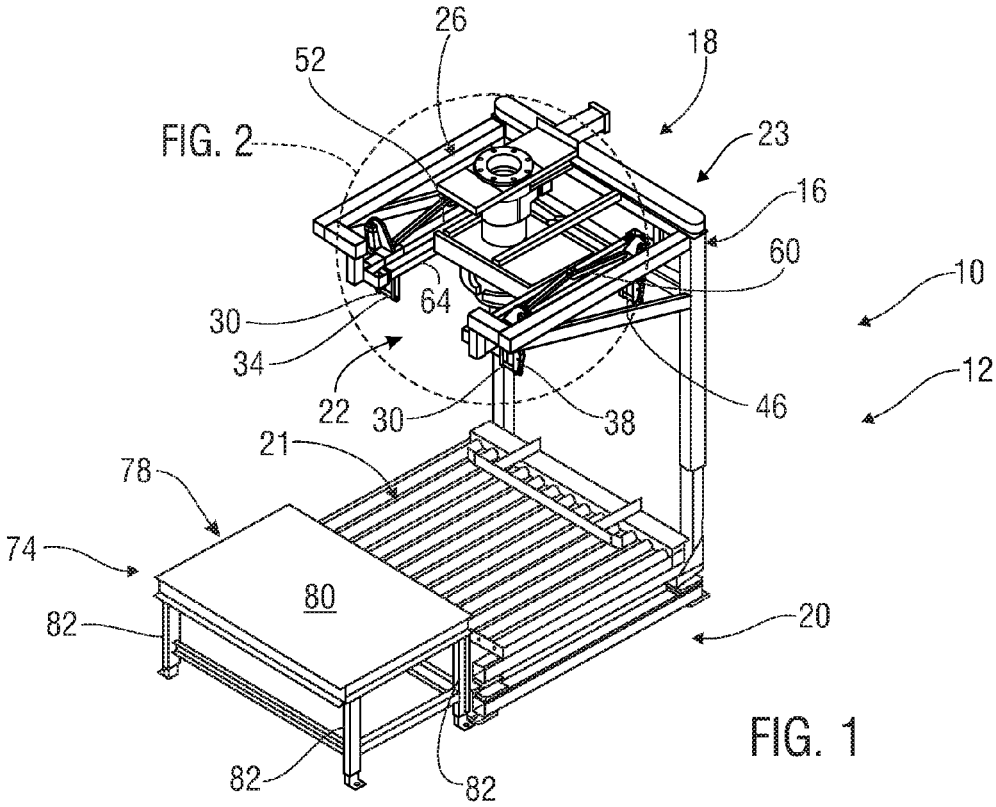
FIG. 1 is a perspective view of an example container filling system including multiple non-manually moveable grippers shown in a first position and an operator platform in accordance with an embodiment of the present disclosure.

Characteristics and advantages of the present invention and additional features and benefits will be readily apparent to those skilled in the art upon consideration of the following detailed description of exemplary embodiments and referring to the accompanying figures. It should be understood that the description herein and appended drawings, being of example embodiments, are not intended to limit the appended claims or the claims of any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are identified by like or identical reference numerals or are apparent from the appended drawings themselves. The figures are not necessarily to scale and certain features and certain views of the figures may be shown exaggerated in scale or in schematic in the interest of clarity and conciseness.

As used herein and throughout various portions (and headings) of this specification, the terms "invention", "present invention" and variations thereof are not intended to refer to every possible embodiment or the claimed invention of any particular claim or claims. Thus, the subject matter of each such reference should not be considered as necessary for, or part of, every embodiment of the invention or any particular claim(s) merely because of such reference. Also, it should be noted that reference herein and in the appended claims to components and aspects in a singular tense does not necessarily limit the present invention to only one such component or aspect, but should be interpreted generally to mean one or more, as may be suitable and desirable in each particular instance.

Referring initially to FIG. 1, an example container filling system 10 is shown. In this example, the container filling system 10 is sometimes referred to as a dry solids filler 12, which is typically useful for filling FIBC's and boxes having flexible liners with a desired bulk material. However, the system 10 is not limited to use as a dry solids filler, or in connection with filling any particular type of container with any particular type of material. Thus, the appended claims are not limited by type of container or material, or the application or machinery with which the present invention is used.

The illustrated container filling system 10 includes a framework 16 having an upper portion 18 that extends over a base 20. The base 20 may include a conveyor 21 and/or any other components. Pallets (not shown) or other removable carriers are often placed atop the base 20. At least one filling spout 26 is provided at the upper portion 18 of the framework 16. The filling spout 26 serves as a port or funnel through which non-liquid material is provided into a container (not shown) that is placed, or held, over the base 20 to be filled.

Figure 2:
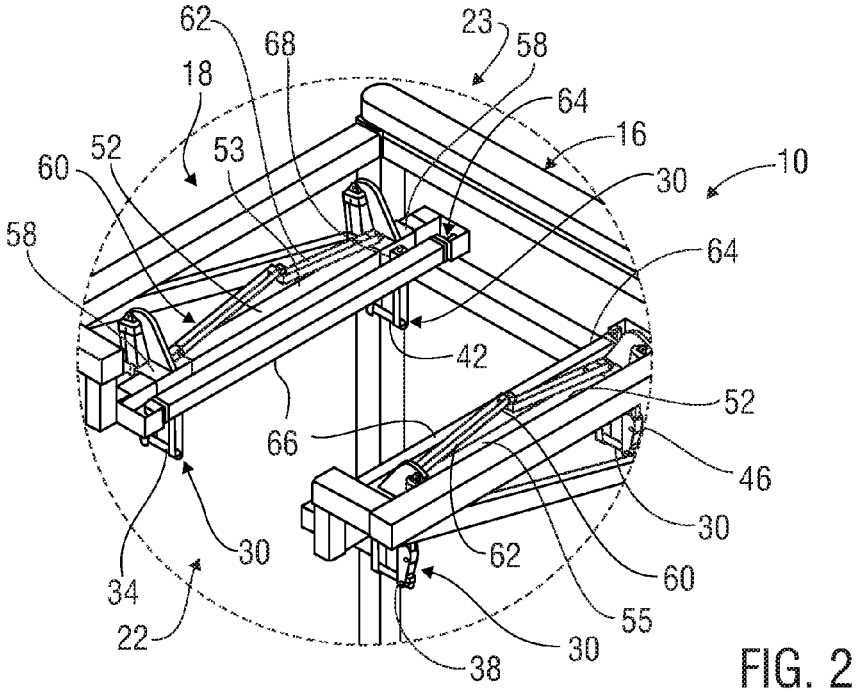
FIG. 2 is a partial exploded view of certain components of the container filling system of FIG. 1.

As shown more particularly in FIG. 2, in this example, the system 10 also includes multiple grippers, or hooks, 30 mounted upon or extending from the framework 16. The illustrated system includes first and second front grippers 34, 38 and first and second rear grippers 42, 46. Typically, the grippers 30 are each capable of being releasably engaged with a different portion of one or more container and assist in holding and positioning the container(s) during filling.

The above-described components are known in the art and may have any suitable form, construction, configuration and operation as is and become further know. Further, the container filling system 10 may include additional components, such as, for example, an automatic pallet dispenser, scale, settler/vibrator, liner throat clamps, bag inflator and vacuum system, all of which may have any suitable form and operation. Moreover, the above-described and any additional components and the operation thereof are not limiting upon the present disclosure or appended claims, except and only to the extent as may be required in the appended claims. Additional descriptions about the above and additional components that may be used in the system 10 and the operation thereof and overall operation of container filling systems are available in publicly available sources, including, without limitation, U.S. Pat. Nos. 6,176,278 to Gill et al. issued on Jan. 23, 2001, 5,259,425 to Johnson et al. issued on Nov. 9, 1993, 6,089,283 to Sienerth et al. issued on Jul. 18, 2000, 5,975,155 to Sienerth et al. issued on Nov. 2, 1999, 5,036,893 to DeCrane issued on Aug. 6, 1991 and 6,776,197 to DeCrane issued on Aug. 17, 2004, each of which is hereby incorporated by reference herein in its entirety. However, nothing in these or any other references is limiting upon the present disclosure.

Now in accordance with an embodiment of the present disclosure, in one independent aspect, referring to FIG. 1, the grippers 30 are each laterally moveable relative to the filling spout 26 or framework 16. As used herein and in the appended claims, the terms "laterally" and variations thereof means in the general direction of the front 22 and/or the rear 23 of the framework 16, and the terms "laterally moveable" and variations thereof means moveable in the general direction of the front 22 and/or the rear 23 of the framework 16. The grippers 30 may be laterally moveable for any desired purpose. For example, the grippers 30 may be laterally moveable to assist in the engagement of one or more container (not shown) within the system 10.

Figure 8:
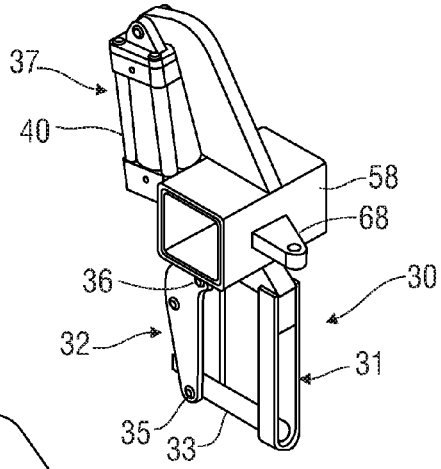
FIG. 8 is a perspective view of an embodiment of a gripper in accordance with the present disclosure.

The grippers 30 may be laterally moveable in any desired manner and with the use of any desired components. In this embodiment, referring particularly to FIG. 2, each gripper 30 includes, or is mounted, such as by weld, onto a glide arm 58 (see also, e.g. FIG. 8). The illustrated glide arm 58 is moveable over, or relative to, a guide rail 52 mounted in the framework 16. Left and right exemplary guide rails 53, 55 are shown extending generally from the front 22 to the rear 23 of the framework 16 in generally parallel spaced relationship with one another. In this example, the front and rear left grippers 34, 42 are moveable relative to a common guide rail 53, while the front and rear right grippers 38, 46 are moveable relative to the same guide rail 55.

The glide arms 58 and guide rails 52 may have any suitable form and configuration. Each illustrated guide rail 52 is a length of square tubing and each exemplary glide arm 58 is a small section of square tubing having an inner diameter (or other dimension) that is slightly larger than the associated guide rail 52 so that it can slide over it. It should be understood, however, that any other suitable form and arrangement of glide arms 58 and guide rails 52, or different components allowing the lateral movement of the grippers 30, may be included.

Still referring to the example of FIG. 2, a distinct driver 64 is shown associated with each of the left and right rear grippers 42, 46. Each illustrated drivers 64 is capable of driving the associated rear gripper back and forth along a desired linear path over the associated guide rail 52. The drivers 64 may have any suitable form, construction, configuration and operation. In this example, each driver 64 is a pneumatically-operated actuator 66, such as a commercially available rodless, double-acting, air cylinder, that is connected to its associated rear gripper 42, 46 such as with a tab 68 (see also, e.g. FIG. 8) to laterally drive the gripper 30 along the desired path.

In this embodiment, the rear grippers 42, 46 (movable by the drivers 64) cause the movement of the front grippers 34, 38 along the associated guide rail 52. The front and rear grippers 30 may be associated in any suitable manner to cause the desired movement of the front grippers 34, 38. In the example shown, the illustrated rear grippers 42, 46 will abut and then push the associated front grippers 34, 38 along the respective guides 53, 55 in the forward direction. In the other direction, the exemplary rear grippers 42, 46 will essentially pull the respective front grippers 34, 38 to the desired position (s).

Any suitable mechanism(s) may be included to allow the rear grippers 42, 46 to move, or connect with, the associated front grippers 34, 38. In the embodiment of FIGS. 1-2, a connection between the respective front and rear grippers is only necessary for the rearward movement of the front grippers 34, 38, since the rear-grippers 42, 46 will push the corresponding front grippers along the guide rails 52 for desired movement in the forward direction. For rearward movement of the illustrated front grippers 34, 38, each front gripper 34, 38 is interconnected with its corresponding respective rear gripper 42, 46 with a dragger, or pull-back mechanism, 60. The dragger 60 is configured to effectively pull the front gripper 34, 38 a desired distance rearward when the associated rear gripper 42, 46 is moving toward the rear 23 of the framework 16. The exemplary draggers 60 are tri-hinged, bi-folding arms 62. However, the draggers 60 may instead include one or more cables, telescoping devices and/or spring-biasing mechanisms (not shown), or any other suitable components. Moreover, the present disclosure includes embodiments in which the front and rear grippers 30 are not interconnected and no dragger 60 is necessary.

Any suitable components or technique may be used to stop the lateral movement of the grippers 30. For example, a forward stop member (not shown) may be associated with one or more of the front or rear grippers 30 to limit the forward movement of the grippers 30. For another example, the drivers 64 may be designed to automatically stop the movement of the grippers 30 at the desired locations. Thus, the present disclosure is not limited by the component(s) or technique(s) used for stopping the lateral movement of the grippers 30.

Figure 6:
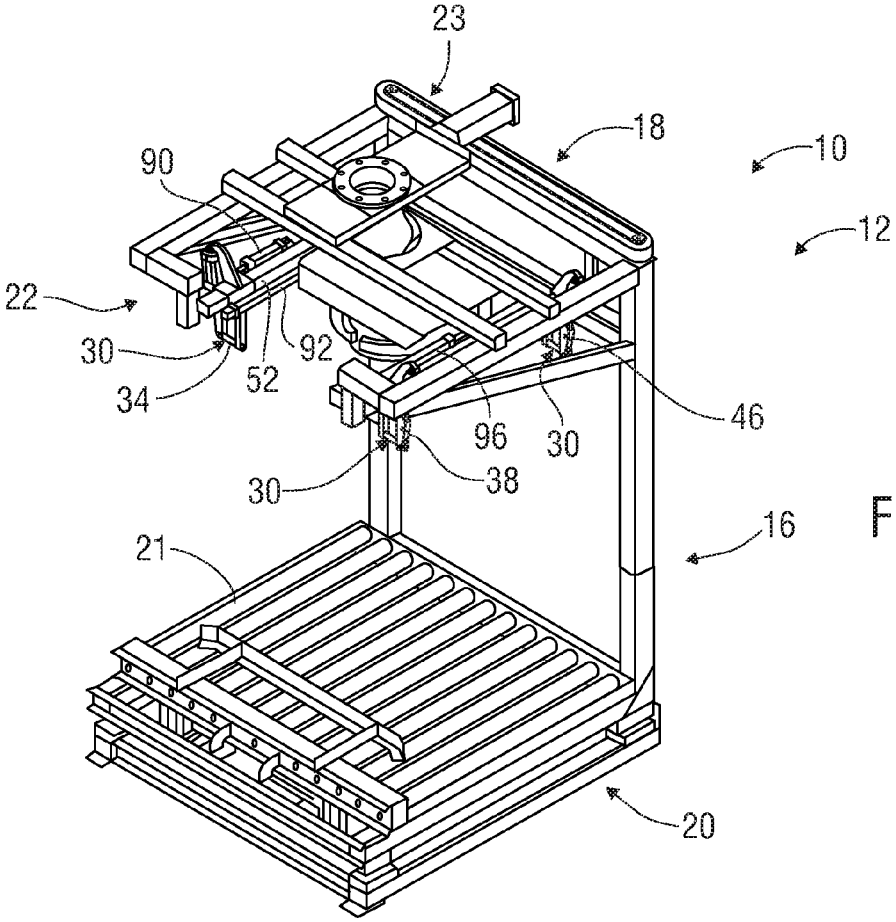
FIG. 6 is a perspective view of a container filling system having four independently power-operated grippers each shown in a first position in accordance with another embodiment of the present invention.
Figure 7:
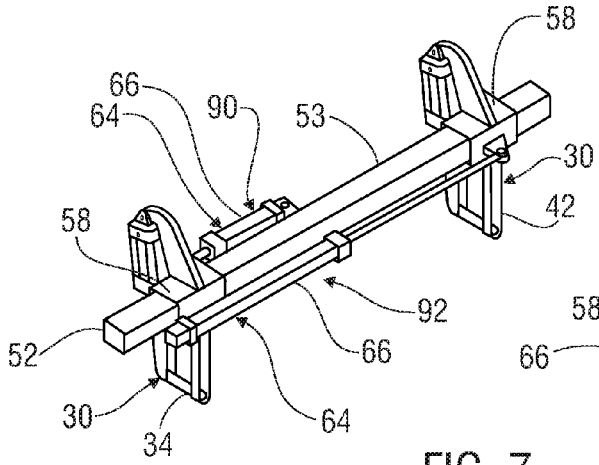
FIG. 7 is an isolated view of the grippers and related components shown in FIG. 6.
Figure 7:
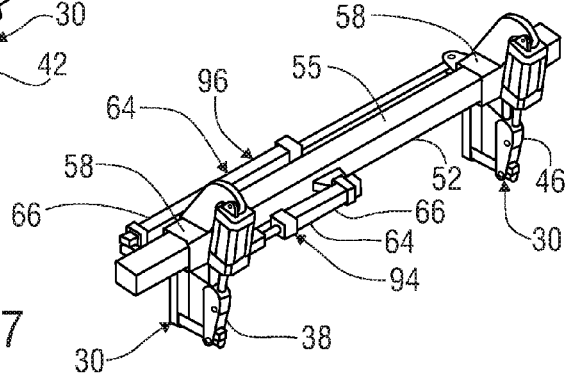

It should be understood that the present disclosure is not limited to the use of four grippers 30 and two drivers 64, as described above with respect to the illustrated embodiment. Any number of grippers 30, drivers 64 and other components may be included. For example, the system 10 may include two or three grippers 30, or five or more grippers 30. For another example, a single driver 64 may be capable of causing movement of all of the grippers 30 in a system 10. For still a further example, referring to the embodiment of FIG. 6, a separate driver 64 may be included for moving each gripper 30 between desired positions. As shown in FIG. 7, this embodiment includes four drivers 64, such as actuators 66. In this example, a first driver 90 moves the left front gripper 34, a second driver 92 moves the left rear gripper 42, a third driver 94 moves the right front gripper 38 and a fourth driver 96 moves the right rear gripper 46. Since each illustrated gripper 30 is independently moveable between positions, the corresponding front and rear grippers are not interconnected.

If desired, when there are multiple drivers 64 in a system, the drivers 64 may take different forms. For example, the drivers 64 may be selected or configured based upon the desired path or distance of travel of the associated gripper(s) 30, the number of positions of the associated gripper(s) 30, or any other desired reason. In the embodiment of FIG. 6, since each gripper 30 is powered by a separate driver 64 and the front grippers 34, 38 will be driven a shorter distance between positions as compared to the rear grippers 42, 46, the drivers 64 associated with the front grippers 34, 38 may have a different capacity and/or size as compared to the drivers 64 associated with the rear grippers 42, 46. In this example, as shown in FIG. 7, the front drivers 90, 94 are smaller than the rear drivers 92, 96.

In accordance with another independent aspect of the present disclosure, referring again to FIG. 1, the grippers 30 may be laterally moveable to and/or from any desired positions. In this embodiment, the grippers 30 are linearly movable along front-rear paths. The illustrated rear grippers 42, 46 are each movable between a rearward "filling position" (e.g. FIGS. 1, 2) and a forward "engaging position" (e.g. FIGS. 3, 4). The filling position of the illustrated rear grippers 42, 46 is generally proximate to the rear 23 of the framework 16 (see also, e.g. FIG. 5). This position is useful during filling of a container engaged in the system 10 and is sometimes referred to as the "home" position of the rear grippers 42, 46.

Figure 3:
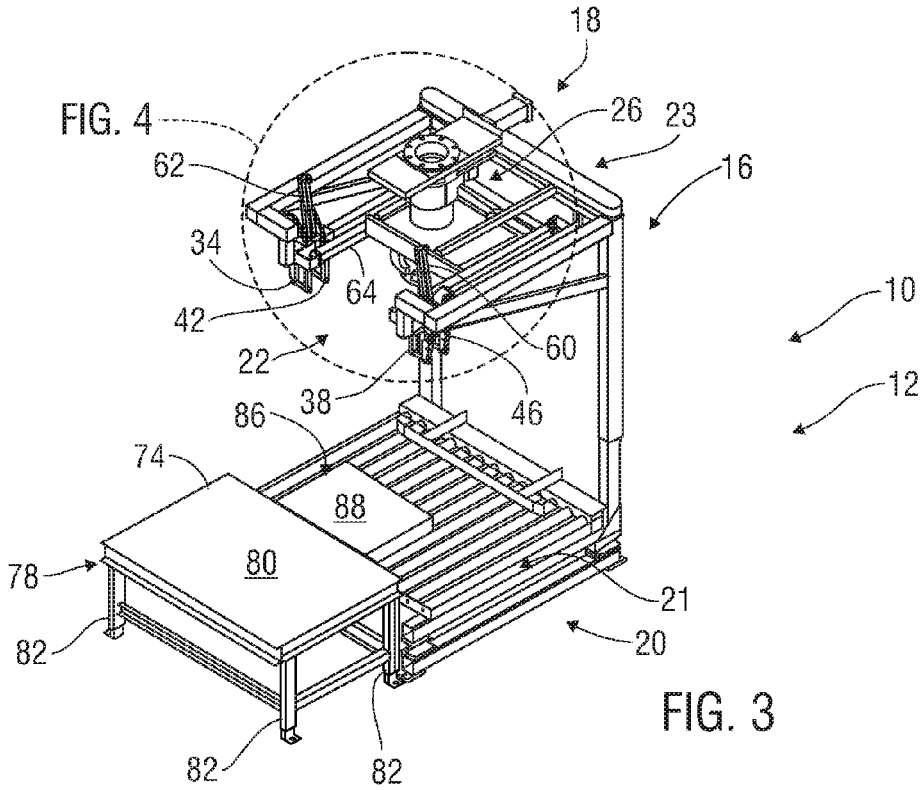
FIG. 3 is a perspective view of the container filling system of FIG. 1 showing the grippers in a second position and a retractable extension of the operator platform in an extended position in accordance with an embodiment of the present disclosure.
Figure 4:
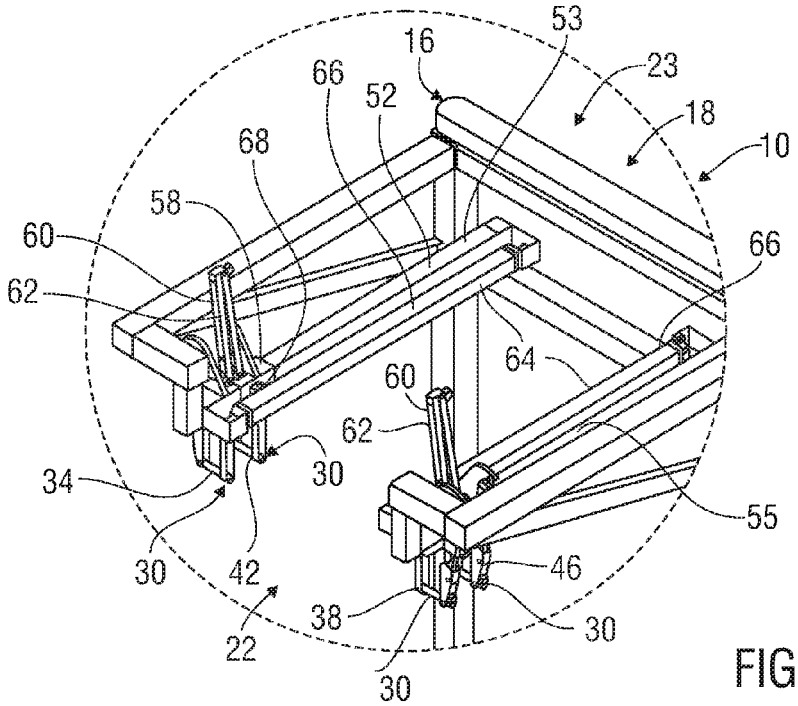
FIG. 4 is a partial exploded view of certain components of the container filling system of FIG. 3.

Referring to FIGS. 3 & 4, the "engaging position" of the rear grippers 42, 46 is closer to the front 22 of the framework 16 and is sometimes referred to herein as their "second" or "forward" position. This position is useful to allow engagement of a container with the rear grippers 42, 46. For example, the engaging position of the rear grippers 42, 46 may permit an operator to engage a container with the rear grippers 42, 46 without the operator having to reach out substantially under the upper portion 18 of the framework 16. However, the present invention is not limited to this purpose or advantage.

For example, there may be embodiments where a human operator is not required for engaging the container(s) to the grippers 30.

The front grippers 34, 38 of this embodiment are each movable between a "filling position" (e.g. FIGS. 1, 2) and a "forward-extended position" (e.g. FIGS. 3, 4). The exemplary filling position is close to the front 22 of the framework 16 and may, if desired, be useful for both engaging the container with the front grippers 34, 38 and filling the container. This position is sometimes referred to as the "home" position of the front grippers 34, 38. Referring to FIGS. 3 & 4, the forward-extended position of the exemplary front grippers 34, 38 is forward of the filling position and, thus, even closer to the front 22 of the framework 16. This position permits positioning the rear grippers 42, 46 in their engaging positions, as described above, and is sometimes referred to herein as the "second" position of the exemplary front grippers 34, 38.

Accordingly, FIGS. 1 & 2 show the home positions of the grippers 30 of this embodiment, in which the front grippers 34, 38 are positioned near the front 22 of the framework 16 and the rear grippers 42, 46 are closer to the rear 23 of the framework 16 so that a container (not shown) hanging therefrom may be filled. FIGS. 3 and 4 illustrate the grippers 30 of this embodiment in their respective second positions.

However, there may be additional or different positions for one or more grippers 30. In one example, the rear grippers 42, 46 may be movable to and from one or more intermediate positions (not shown) between their engaging and filling positions. For example, after a container is engaged with the exemplary rear grippers 42, 46, as the rear grippers 42, 46 are moved rearwards toward their filling positions, the grippers 42, 46 may be temporarily stopped at an intermediate position forward of their filling positions, but rearward of the filling spout 26. This intermediate position may, for example, allow the container (already engaged with the rear grippers 42, 46) to be connected to the filling spout 26 before the rear grippers 42, 46 are in their filling positions. In some embodiments, the container may be a bag (not shown) having a centrally-located fill throat that would be more easily engaged with the filling spout 26 when the rear grippers 42, 46 are in an intermediate position because of less tension on the container as compared to when the rear grippers 42, 46 are in their further rearward filling positions. For another example, different positions of the grippers 30 may be provided to accommodate different sized or types of containers. Thus, there is no limit to the number and location of positions of the grippers 30.

In accordance with another independent aspect of the present disclosure, the system 10 may be configured to laterally move the grippers 30 any desired distance. The distance any of the grippers 30 are moveable may depend upon one or more factors, such as, for example the size and other components of the filling system 10, size and/or type of containers to be filled or other variables. In one particular configuration of the embodiment of FIG. 1, the distance between the home and engaging positions of the rear grippers 42, 46 is approximately thirty nine inches and the distance between the forward-extended and home positions of the front grippers 34, 38 is six inches. However, the grippers 30 may be moved more or less than those distances. For example, the distance between the filling and engaging positions of the rear grippers 42, 46 may, in various embodiment, be approximately thirty, forty or sixty inches, while the movable distance for the front grippers 34, 38 may be approximately sixteen or twenty inches.

Figure 9:
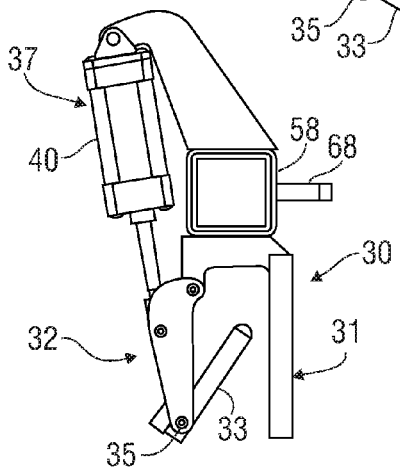
FIG. 9 is a front view of the gripper of FIG. 8 shown in a container engaging position.

The grippers 30 may have any suitable form, configuration and operation, as long as they are non-manually laterally movable between desired positions and capable of releasably engaging and holding one or more containers. As used herein the term "gripper" means any suitable structure or assembly capable of releasably engaging and/or holding up a portion of a container during filling of the container with non-liquid material. In the present embodiment, referring to FIG. 8, each gripper 30 includes first and second arms 31, 32. The illustrated second arm 32 includes a lower finger 33 that is pivotable about a pin 35 between a closed position (e.g. FIG. 8) and an open position (e.g. FIG. 9) to allow engagement of a container therewith. If desired, the finger 33 may be spring-biased in the closed position. To engage a container with the gripper 30, an operator may manually push open the finger 33 and hang a loop or other portion (not shown) of a container thereon, then allow the finger 33 to return to the closed position.

Figure 10:
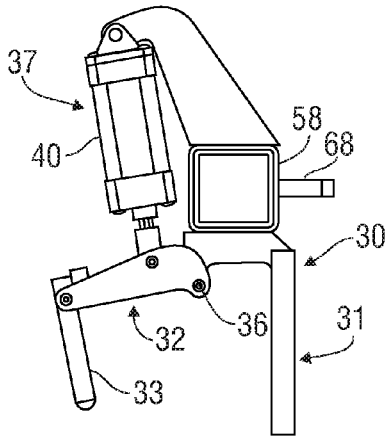
FIG. 10 is a front view of the gripper of FIG. 8 shown in a container disengaging position.

Referring again to FIG. 8, the first arm 31 of this example is stationary and the second aim 32 is moveable relative to the first arm 31 to allow the release or disengagement of a container engaged with the gripper 30. In this example, the second arm 32 is pivotable about a pin 36 between a closed position (e.g. FIG. 8) and an open position (e.g. FIG. 10). The second arm 32 may be moveable to allow disengagement of the container(s) in any suitable manner. In this example, the second arm 32 is power-operated between open and closed positions by an actuator 37, such as a double-acting, rodded, pneumatic cylinder. However, the present disclosure and appended claims are not limited to the gripper 30 as described above and shown in the appended figures. Any suitable hanger, hook, engager or other mechanism may be used.

Referring again to FIG. 1, in another independent aspect of the present disclosure, the container filling system 10 may include an operator platform 74. The platform 74 may be included for any desired purpose. For example, the operator platform 74 may allow an operator to couple one or more container (not shown) with the filling spout 26, inspect, maintain and/or service the filling spout 26 or other components of the container filling system 10, or other purpose. In some embodiments, the use of the operator platform 74 may be beneficial with respect to speed and ease or use and/or operator safety during use, maintenance and/or repair of the system 10.

The operator platform 74 may have any suitable components, configuration and operation. In the embodiment of FIG. 1, the operator platform 74 includes a stand 78 positionable adjacent to the framework 16 and/or the base 20 (see also, e.g., FIG. 5). The exemplary stand 78 includes a top 80 and four legs 82 that provide sufficient support and stability to hold at least one operator standing upon the top 80 and operating, inspecting, maintaining, repairing the system 10, or performing another desired function. The illustrated platform 74 is capable of being bolted to the floor or other underlying surface and is not connected to the framework 16. However, the platform 74 may be connectable to the framework 16 or other structure(s) and not bolted to the floor or other underlying surface, or otherwise configured and stabilized, as desired.

Figure 5:
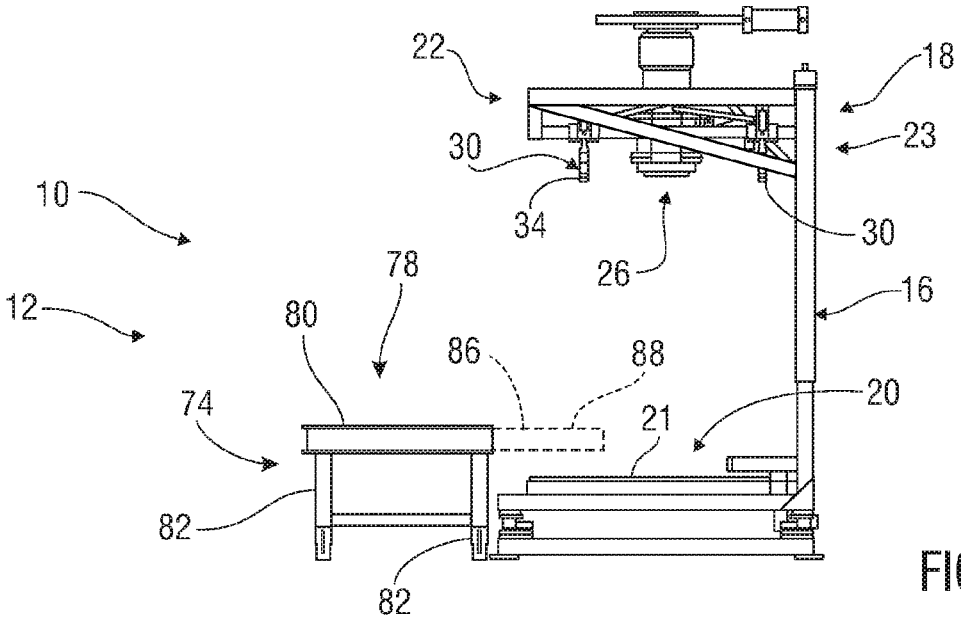
FIG. 5 is a side view of the container filling system of claim 1.

Referring now to FIG. 3, the platform 74 of the present embodiment includes a retractable extension 86 capable of extending out at least partially over the base 20 to allow the operator(s) to be located over the base 20 or under the upper portion 18 of the framework 16. The retractable extension 86 may be included for any desired purpose, such as, for example, to connect one or more containers (not shown) to the filling spout 26, clean, inspect, maintain and/or service the filling spout 20 or other components of the container filling system 10, or one or more other desired purpose. As shown in FIG. 5, the illustrated operator platform 74 is configured so that height of the extension 86 in an extended position will be above the height of the conveyor 21, pallet, etc. The exemplary platform 74 provides sufficient support for the extension 86, and the extension 86 is sufficiently sturdy, so that at least one operator may stand upon the extension 86 and perform his/her desired duties.

The retractable extension 86 may have any suitable components, configuration and operation. Referring again to FIG. 3, in the example shown, the retractable extension 86 include a catwalk 88 that resides below the top 80 of the stand 78 when retracted. The catwalk 88 may have any suitable shape, form and configuration. For example, the catwalk 88 may be a plate-like member, include side safety lips (not shown) or any other desired components or features. The illustrated catwalk 88 is mounted on a set of linear bearings (not shown) that slide in a pair of corresponding rails (not shown), which operate similar to various conventional desk drawers to allow the catwalk 88 to be extended and retracted as desired. However, the catwalk 88 may be connected to the platform 74 and operate in any other desired manner and with any other suitable components.

The platform 74 may have additional components or features. For example, the platform 74 may include hand rails (not shown) extending upwardly from the top 80 or other component. If included, the hand rails may be extendable over the base 20 of the framework 16 along with the extension 86. If desired, the extension 86 may be controllable by an operator separate from the other components of the system 10, such as with the use of a dedicated control switch (not shown).

The container filling system 10 may be operated in any suitable manner. For example, one or more computer software-driven or otherwise electronic controllers (not shown) may be used to actuate one or more of the drivers 64, actuators 37 and other desired components of the system 10. For example, the controller may be designed so that a total of one or two operator commands (e.g. actuation of a switch) may control all of the operations of the system 10 in filling, releasing and moving a container. It should be noted that while the involvement of a human operator in engaging the container(s) (not shown) with the grippers 30 has been described with respect to particular embodiments, the entire process may be automated or otherwise computer-software driven. Further, the components and techniques used in controlling the system 10 are not limiting upon the present disclosure or the appended claims.

In accordance with another independent aspect of the present disclosure, an embodiment of a method of non-manually laterally moving multiple grippers 30 of a container filling system 10 will now be described with reference to FIGS. 1-10. However, it should be understood that reference to FIGS. 1-10 is for illustrative purposes only. Neither this embodiment of a method of operation nor the present disclosure should be limited to use with the illustrated embodiments.

In accordance with this embodiment, referring to FIGS. 3 & 4, when it is desired to connect a container (not shown) to the system 10, the rear gripper 42, 46 are placed in their engaging positions. For example, if the rear grippers 42, 46 are not in engaging positions, the appropriate drivers 64 may be actuated to move the rear grippers 42, 46 along the respective guide rails 52 toward the front 22 of the framework 16. The drivers 64 may be actuated in any desired manner, such as by a software-driven controller.

In use of the embodiment of FIG. 3, the actuators 66 will be actuated to move the rear grippers 42, 46 forward and eventually into contact with the corresponding front grippers 34, 38. The rear grippers 42, 46 will abut and push the respective front gripper 34, 38 forward a desired distance. In this example, in order to position the rear grippers 42, 46 in their engaging positions, the front grippers 34, 38 will be pushed to their forward-extended positions (see e.g. FIG. 4). For another example, in use of the embodiment of FIGS. 6 & 7, the drivers 90, 94 will be actuated to move the front grippers 34, 38 to a forward-extended position and the drivers 92, 96 will be actuated to move the rear grippers 42, 46 to their engaging positions.

After the rear grippers 42, 46 are moved to an engaging position, the container may be connected to the rear grippers 42, 46. For example, if the grippers 30 are the type shown in FIGS. 8-10, the operator may engage a portion, such as a loop, of the container (not shown) with the lower finger 33 of each rear gripper 42, 46 so that the container hangs from the grippers 42, 46. If the system 10 includes an operator platform 74, the operator may stand on the top 80 of the stand 78 to connect the container with the rear grippers 42, 46.

The rear grippers 42, 46 may thereafter be moved toward the rear 23 of the framework 16. In use of the embodiments of FIGS. 1 and 6, the drivers 64 associated with the rear grippers 42, 46 may be actuated, similarly as described above, to move the rear grippers 42, 46 directly to their filling positions. However, in other embodiments, the rear grippers 42, 46 may be moved to an intermediate position.

When the rear grippers 42, 46 of FIG. 1 are moved to their filling positions, they will pull the front grippers 34, 38 to their filling positions. For example, referring to FIG. 4, the bi-folding arms 62 of this embodiment will extend or expand out between corresponding front and rear grippers, pulling the front grippers 34, 38 from their forward extended positions to their filling positions (e.g. FIG. 2). In the embodiment of FIG. 6, the front grippers 34, 38 are independently moveable to their filling positions by their drivers 90, 94, respectively.

If the system 10 includes the operator platform 74, the operator may cause the extension 86 to extend out from the platform 74 over the base 20 of the framework 16, such as shown in FIG. 3. The operator may then step out onto the extension 86 and, in some applications, manually connect a central opening, neck, or other part of the container (not shown) to the filling spout 26, as is or becomes further known. The operator may then return back to the top 80 of the platform 74, retract the extension 86 and connect the container to the front grippers 34, 38, similarly as described above with respect to the rear grippers 42, 46.

After all the grippers 30 are positioned in their filling positions, the container may be filled with non-liquid material, as desired and as is or becomes further known. When it is desired to remove the container from the system 10, the grippers 30 may be opened to disengage the container therefrom. For exampled, referring to FIG. 10, the actuators 37 may be automatically actuated to open each gripper 30. The container is otherwise separated from the system 10 as is or becomes known and, if included, the conveyor 21 may move the container away from the system 10 as desired. However, the present disclosure is not limited to or require these particular actions.

Preferred embodiments of the present invention thus offer advantages over the prior art and are well adapted to carry out one or more of the objects of the invention. However, the present invention does not require each of the components and acts described above and is in no way limited to the above-described embodiments, methods of operation, variables or values. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the invention and the appended claims should not be limited to the embodiments described and shown herein.

The invention claimed is:

1. An apparatus useful for filling non-liquid material into a container, the container being releasably engageable with the apparatus, the apparatus having a framework that includes an upper portion, a base, a front end and a rear end, and at least one filling spout associated with the upper portion, the apparatus comprising:

first and second front grippers associated with the framework, each said front gripper being releasably engageable with a different portion of the container;

first and second rear grippers associated with the framework, each said rear gripper being releasably engageable with a different portion of the container, said first and second rear grippers being linearly aligned with said first and second front grippers, respectively, wherein at least one of said front and rear grippers is power-operated;

at least one driver associated with at least one of said grippers and capable of causing the non-manual lateral movement of all of said grippers; and a first dragger engaged between said first front and rear grippers and a second dragger engaged between said second front and rear grippers, said first and second draggers capable of allowing said first and second rear grippers to pull said respective first and second front grippers from said second to said respective first positions thereof, wherein said first and second rear grippers are each non-manually laterally movable between a first position that allows filling of a container engaged therewith and a second position that is forward of said first position and allows engagement of a container therewith, and said first and second front grippers are each non-manually laterally movable between a first position that allows filling of a container engaged therewith and a second position that is laterally forward of said first position and provides clearance for movement of said respective associated rear gripper into its second said position.

2. The apparatus of claim 1 wherein said second position of each of said rear grippers allows engagement of a container therewith by an operator without having to reach out substantially laterally under the upper portion of the framework.

3. The apparatus of claim 1 wherein said at least one driver is pneumatically-actuated.

4. The apparatus of claim 3 wherein said at least one driver is a dual-acting air cylinder.

5. The apparatus of claim 1 wherein each said dragger includes at least one among at least one bi-folding arm, at least one cable, at least one telescoping member and at least one spring.

6. The apparatus of claim 1 further including a first said driver associated with said first rear gripper and capable of assisting in laterally moving said first front and rear grippers, and a second said driver associated with said second rear gripper and capable of assisting in laterally moving said second front and rear grippers.

7. The apparatus of claim 1 wherein at least one of said grippers is movable into and out of at least one intermediate position disposed between said first and second respective positions thereof.

8. The apparatus of claim 7 wherein each of said first and second rear grippers is movable into an intermediate position, whereby when a container is engaged with said first and second rear grippers disposed in said intermediate positions, the container is engageable with the filling spout without substantial tension on the container.

9. An apparatus useful for filling non-liquid material into a container, the container being releasably engageable with the apparatus, the apparatus having a framework that includes an upper portion, a base, a front end and a rear end, and at least one filling spout associated with the upper portion, the apparatus comprising:

first and second front grippers associated with the framework, each said front gripper being releasably engageable with a different portion of the container;

first and second rear grippers associated with the framework, each said rear gripper being releasably engageable with a different portion of the container, said first and second rear grippers being linearly aligned with said first and second front grippers, respectively, wherein at least one of said front and rear grippers is power-operated; and first and second drivers associated with said first and second front grippers, respectively, and third and fourth drivers associated with said first and second rear grippers, respectively, each said driver capable of non-manually laterally moving said associated gripper between said first and second respective positions thereof, wherein said first and second rear grippers are each non-manually laterally movable between a first position that allows filling of a container engaged therewith and a second position that is forward of said first position and allows engagement of a container therewith, and said first and second front grippers are each non-manually laterally movable between a first position that allows filling of a container engaged therewith and a second position that is laterally forward of said first position and provides clearance for movement of said respective associated rear gripper into its second said position.

10. The apparatus of claim 9 wherein said first and second drivers are smaller than said second and third drivers.

11. The apparatus of claim 9 wherein at least one of said grippers is movable into and out of at least one intermediate position disposed between said first and second respective positions thereof.

12. The apparatus of claim 11 wherein each of said first and second rear grippers is movable into an intermediate position, whereby when a container is engaged with said first and second rear grippers disposed in said intermediate positions, the container is engageable with the filling spout without substantial tension on the container.

13. An apparatus useful for filling non-liquid material into a container, the container being releasably engageable with the apparatus, the apparatus having a framework that includes an upper portion, a base, a front end and a rear end, and at least one filling spout associated with the upper portion, the apparatus comprising:

first and second front grippers associated with the framework, each said front gripper being releasably engageable with a different portion of the container;

first and second rear grippers associated with the framework, each said rear gripper being releasably engageable with a different portion of the container, said first and second rear grippers being linearly aligned with said first and second front grippers, respectively;

first and second power-operated drivers associated with said first and second rear grippers, respectively, said first and second power-operated drivers capable of allowing the non-manual lateral movement of all of said grippers between at least two positions, wherein said first and second power-operated drivers are capable of moving said first and second rear grippers between a rearward home position and a forward position, respectively, and said first and second rear grippers are capable of pushing said first and second front grippers from a home position to a forward position, respectively; and a first dragger connecting said first front and rear grippers and a second dragger connecting said second front and rear grippers, said first and second draggers allowing said first and second rear grippers to pull said first and second front grippers from said forward to said home positions thereof, respectively.

14. The apparatus of claim 13 wherein said forward position of each of said rear grippers allows engagement of a container therewith by an operator without having to reach out substantially laterally under the upper portion of the framework.

15. The apparatus of claim 14 wherein said first and second drivers are capable of moving said first and second rear grippers into an intermediate position between said home and said forward positions thereof, respectively.

16. The apparatus of claim 15 wherein said intermediate positions of said first and second rear grippers allows engagement of the container with the filling spout without substantial tension on the container.

17. A method of filling non-liquid material into a container with the use of an apparatus having a framework that includes an upper portion, a base, a front end and a rear end, at least one filling spout associated with the upper portion and first and second front and rear grippers each capable of engaging a different portion of the container, the first front and rear grippers being linearly aligned and the second front and rear grippers being linearly aligned, the apparatus comprising:

non-manually moving each of the rear grippers to a forward position;

non-manually laterally moving each of the front grippers to a forward-extended position, allowing movement of the associated rear grippers to their forward positions, respectively;

engaging the container with each of the rear grippers;

non-manually moving each of the rear grippers to an intermediate position disposed between its filling position and the filling spout prior to engaging the container with the filling spout;

non-manually laterally moving each of the front grippers rearward to a filling position;

engaging the container with the filling spout;

non-manually moving each of the rear grippers rearward to a filling position; and engaging the container with each of the front grippers.

18. The method of claim 17 further including connecting together the first front and rear grippers and connecting together the second front and rear grippers, respectively, wherein each of the rear grippers pulls its associated front gripper from its forward-extended position to its filling position.

19. The method of claim 17 wherein each of the rear grippers pushes its associated front gripper from its filling position to its forward-extended position.

20. The method of claim 17 further including associating a power-operated driver with each of the rear grippers, wherein each power-operated driver moves its associated rear gripper between positions.

21. A method of filling non-liquid material into a container with the use of an apparatus having a framework that includes an upper portion, a base, a front end and a rear end, at least one filling spout associated with the upper portion and first and second front and rear grippers each capable of engaging a different portion of the container, the first front and rear grippers being linearly aligned and the second front and rear grippers being linearly aligned, the apparatus comprising:

associating a distinct power-operated driver with each of the first and second front and rear grippers, wherein each power-operated driver moves its respective gripper between positions non-manually moving each of the rear grippers to a forward position;

non-manually laterally moving each of the front grippers to a forward-extended position, allowing movement of the associated rear grippers to their forward positions, respectively;

engaging the container with each of the rear grippers;

non-manually moving each of the rear grippers rearward to a filling position;

non-manually laterally moving each of the front grippers rearward to a filling position;

engaging the container with the filling spout; and engaging the container with each of the front grippers.

* * * * *